US006145971A

United States Patent [19]

Baker et al.

[11] Patent Number: 6,145,971

[45] Date of Patent: Nov. 14, 2000

[54] PRINTER INK PUMP AND METHOD OF SUPPLYING INK USING MOTION OF THE CARRIER

[75] Inventors: Ronald Willard Baker, Versailles; William P. Cook, Lexington; Philip Jerome Heink, Lexington; Jeffrey Lynn Richie, Lexington; Donald Wayne Stafford, Richmond, all of Ky.

[73] Assignee: Lexmark International, Inc., Lexington, Ky.

[21] Appl. No.: 09/521,699

[22] Filed: Mar. 9, 2000

[51] Int. Cl.[7] ..... B41J 2/175

[52] U.S. Cl. ..... 347/85

[58] Field of Search ..... 347/85, 37, 86, 347/87; 346/140.1

[56] References Cited

U.S. PATENT DOCUMENTS

| | | | |
|---|---|---|---|
| 4,323,907 | 4/1982 | Italiano . | |
| 4,347,524 | 8/1982 | Engel et al. . | |
| 4,394,669 | 7/1983 | Ozawa et al. . | |
| 4,429,320 | 1/1984 | Hattori et al. . | |
| 4,433,341 | 2/1984 | Thomas . | |
| 4,462,037 | 7/1984 | Bangs et al. . | |
| 4,475,116 | 10/1984 | Sicking et al. . | |
| 4,876,558 | 10/1989 | Mamiya . | |
| 4,937,598 | 6/1990 | Hine et al. . | |
| 5,189,438 | 2/1993 | Hine et al. . | |
| 5,745,137 | 4/1998 | Scheffelin et al. . | |
| 5,751,300 | 5/1998 | Cowger et al. . | |
| 5,852,458 | 12/1998 | Scheffelin et al. . | |
| 5,980,028 | 11/1999 | Seccombe | 347/85 |

FOREIGN PATENT DOCUMENTS

| | | | |
|---|---|---|---|
| 2-266952 | 10/1990 | Japan | 347/85 |

*Primary Examiner*—David F. Yockey
*Attorney, Agent, or Firm*—Gregory J. Kirsch, Esq.; D. Brent Lambert

[57] ABSTRACT

A system and method for supplying ink to a print head on a moving carrier using the acceleration of the print head carrier to assist in pumping the ink. The system includes an ink supply reservoir and an ink pump on the moving carrier where the ink pump has a carrier reservoir including at least one flexible wall that deforms from inertial resistance to acceleration of the moving carrier, a print head, and a pressure regulator in fluid communication with the carrier reservoir and the print head. The system also has an ink supply tube in fluid communication with the ink supply reservoir and the carrier reservoir such that acceleration of the moving carrier and ink pump deforms the flexible wall and thereby pumps ink from the ink supply reservoir to the carrier reservoir and from the carrier reservoir to the print head, or solely to the carrier reservoir. The flexible wall preferably includes a mass integrated therewith that increases inertial resistance to the acceleration of the moving carrier and deformation of the flexible wall, and the carrier reservoir preferably includes a rigid member in its interior that prevents deformation of the flexible wall into the interior of the carrier reservoir. The method includes providing ink in a stationary ink supply reservoir, accelerating the moving carrier, and pumping ink from the ink supply reservoir to a print head using a flexible wall in the ink pump that deforms from inertial resistance to the acceleration of the moving carrier.

19 Claims, 3 Drawing Sheets

PRINTER INK PUMP AND METHOD OF SUPPLYING INK USING MOTION OF THE CARRIER

BACKGROUND OF THE INVENTION

1. Field of the Invention

The present invention generally relates to printers. More particularly, the present invention relates to a pump utilizing the inertia of the moving print head carrier to pump ink from an ink supply reservoir to the print head.

2. Description of the Related Art

A common ink supply in printers, such as an inkjet printer, supplies a continuous stream of ink from a stationary ink reservoir to either a carrier reservoir on the print head carrier or directly to a print head being moved intermittently across a media being printed upon, such as a page of paper. In order to induce the ink to flow from the ink supply reservoir ultimately to the print head, the printer might include a device, commonly, a pump, for generating some pressure on the ink in the system. The pumps and other devices can either supply positive pressure to the ink supply reservoir to push ink from the ink supply reservoir, or negative pressure at the print head carrier to pull ink from the ink supply reservoir. In either method, the pump or other device utilizes an external source of power to operate.

Prior art ink pumps often utilize the electrical supply of the printer to power the pump components for ink pressure generation. Other pumps and devices known in the art use a direct or indirect mechanical connection to the printer or print head in order to actuate the pressure-generating components. Additional components of the pump increase complexity in manufacture of the printer and a greater number of parts can individually fail and increase the possibilities of overall printer failure due to individual component breakdown.

Therefore, it would be advantageous to include a pump in a printer that does not require an external source of power to pump ink to the print head. In such a printer, a source of existing mechanical force or pressure of the printer could be advantageously used to cause ink transfer at a sufficient rate to supply the print head with ink. Accordingly, it is to the provision of such a system and method that the present invention is primarily directed.

SUMMARY OF THE INVENTION

The present invention is a system and method for supplying ink to a print head on a moving carrier using the motion of the ink pump on the carrier to assist the pumping of ink from an ink supply reservoir to a print head. The system preferably is comprised of an ink supply reservoir, and an ink pump on the moving carrier where the ink pump has a carrier reservoir including at least one flexible wall, a print head, and a pressure regulator in fluid communication with the carrier reservoir and the print head. The flexible wall of the ink pump deforms from inertial resistance to acceleration of the moving carrier. The system also includes an ink supply tube in fluid communication with the ink supply reservoir and the carrier reservoir. The acceleration of the print head carrier causes the flexible wall to create either positive or negative pressure within the carrier reservoir, depending on the motion of the print head carrier, which pumps ink from the ink supply reservoir to the print head, or to the carrier reservoir and from the carrier reservoir to the print head. The system alternately includes a check valve in the ink supply tube between the ink supply reservoir and the carrier reservoir.

The flexible wall alternately includes a mass integrated therewith, and the mass increases inertial resistance to the acceleration of the moving carrier and causes greater force on the flexible wall to create greater internal pressures within the carrier reservoir. To improve the pumping action of the deforming flexible wall, the carrier reservoir preferably includes a rigid member in the interior of the carrier reservoir such that the rigid member prevents deformation of the flexible wall into the interior of the carrier reservoir. The rigid member in the interior of the carrier reservoir is preferably a porous wall.

The present invention further includes the inventive ink pump on the moving carrier and connected to the print head. The ink pump includes a rigid body having an interior comprising a carrier reservoir, and the body includes at least one flexible wall that deforms from inertial resistance to acceleration of the moving carrier. A pressure regulator is in fluid communication between the carrier reservoir and the print head, where the pressure regulator regulates the pressure of ink flowing from the carrier reservoir to the print head. An ink supply provides ink to the carrier reservoir from a separate ink supply.

The inventive ink pump and system thus provide a method of supplying ink to a print head on a moving carrier in a printer including the steps of: providing ink in a stationary ink supply reservoir, moving the ink pump with the carrier, and pumping ink from the ink supply reservoir to a print head using a flexible wall in the ink pump that deforms from inertial resistance to the acceleration of the moving carrier. When the ink pump further includes a carrier reservoir, the method further includes the step of pumping ink from the ink supply reservoir to a carrier reservoir using a flexible wall in the carrier reservoir that deforms from inertial resistance to the acceleration of the moving carrier. Then the step of pumping ink from the ink supply reservoir to a print head using a flexible wall in the carrier reservoir is preferably pumping ink from the carrier reservoir to a print head using a flexible wall in the carrier reservoir that deforms from inertial resistance to the acceleration of the moving carrier.

The method further preferably includes the step of integrating a mass with the flexible wall such that the weight increases the force upon the flexible wall to resist the acceleration of the moving carrier. Then the method preferably includes the step of restraining the deformation of the flexible wall into an interior of the carrier reservoir, preferably through the provision of a rigid member, such as a porous wall, in the interior of the carrier reservoir such that the rigid member prevents deformation of the flexible wall into the interior of the carrier reservoir.

The present invention therefore has a commercial advantage in that it provides an economical system for delivery of ink from the printer cartridge. The system has simple parts that can be installed in the printer as is it manufactured. Moreover, the system and method expands the ink carrying capacity of a printer cartridge as a minimum of wasted ink remains unused in the printer cartridge utilizing the ink pump of the present invention.

Further, the present invention has industrial applicability as it is particularly advantageous for usage in printer cartridges for ink jet printers. The installation of the air pump and associated tubes into the ink jet printer as it is manufactured provides an adequate solution to the ink supply problems associated with the ink jet printers as discussed above.

Other objects, features, and advantages of the present invention will become apparent after review of the hereinafter set forth Brief Description of the Drawings, Detailed Description of the Invention, and the Claims.

DETAILED DESCRIPTION OF THE INVENTION

Figure 1:
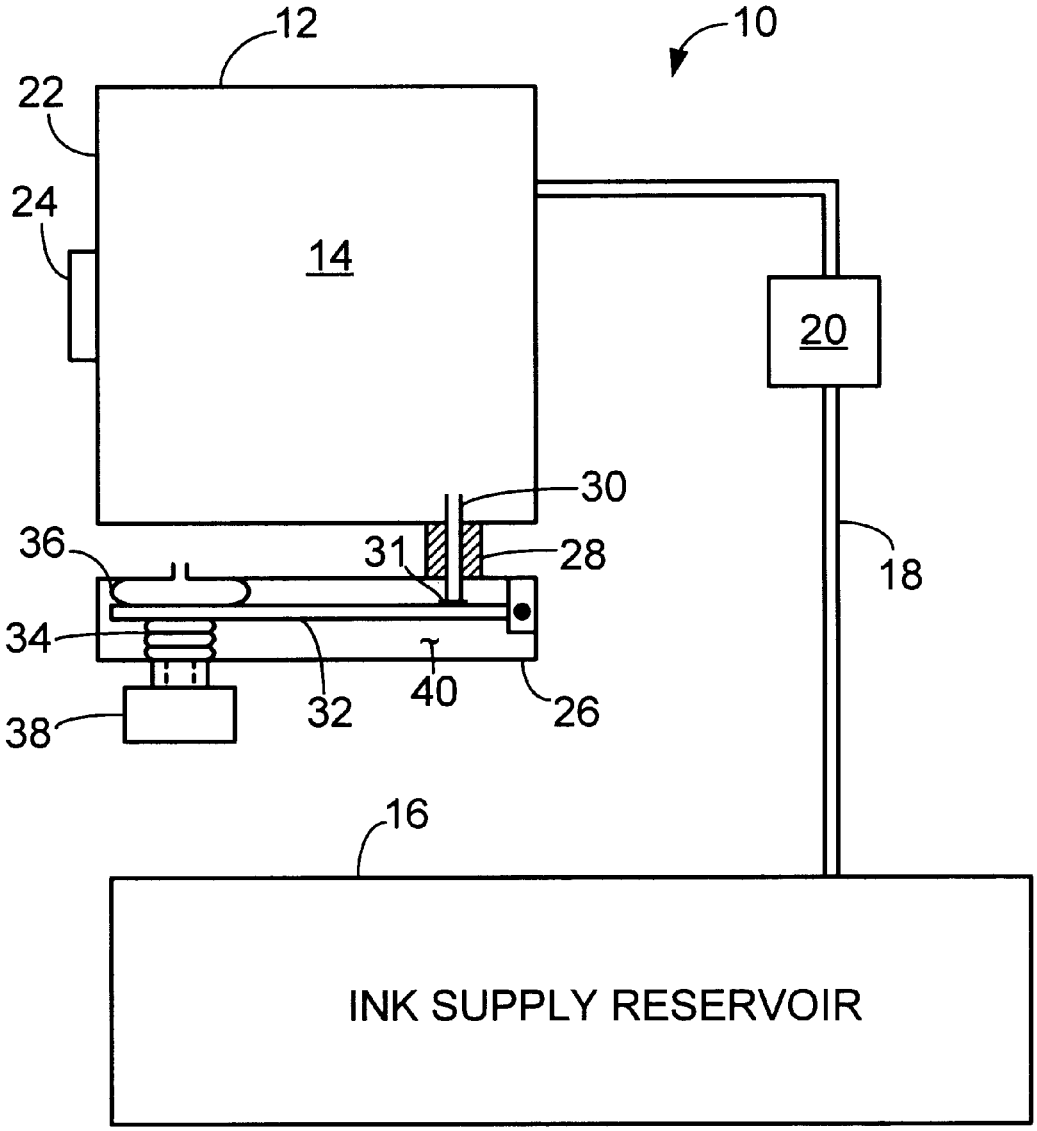
FIG. 1 is a representative diagram of the preferred embodiment of the ink supply system for a print head on a moving carrier.

Referring now to the drawings in which like numerals represent like components throughout the several views, FIG. 1 illustrates an ink supply system 10 for a print head 38 on a moving carrier comprised of and an ink pump 12 on the moving carrier where the ink pump 12 has a carrier reservoir 14 in connection to an ink supply reservoir 16 through an ink supply tube 18. The ink supply tube 18 is shown as containing a one-way check valve 20 to control the flow of ink through the ink supply tube 18. The inclusion of the check valve 20 is preferred, but not necessary, to regulate the flow of ink through the ink supply tube 18.

The carrier reservoir 14 includes at least one flexible wall 22 that deforms from inertial resistance to acceleration of the moving carrier, and thus, the ink pump 12. The flexible wall 22 preferably has an integrated mass, such as integrated weight 24, that increases inertial resistance of the flexible wall 22 to acceleration of the ink pump 12 and creates a greater pumping action in the carrier reservoir 14.

The ink pump 12 further includes a print head 38, and preferably a pressure regulator 26 in fluid communication with the carrier reservoir 14 and the print head 38. In order to maintain good print quality and avoid other print head 38 problems such as "drooling" or "depriming," a pressure regulator 26 should be placed between the carrier reservoir 14 and before the actual print head 38 itself.

As embodied in FIG. 1, the pressure regulator is connected to the ink pump 12 through a connecting tube 28. Generally, the print head requires that the ink be at a slightly negative pressure with respect to the ambient air and the pressure regulator is designed to maintain this pressure within acceptable limits. An exemplary pressure regulator 26 is shown in FIG. 1 having an ink tube 30 extending through the connecting tube 28 and into the carrier reservoir 14. The ink tube 30 rests against a compliant stopper 31 that is on pivoting lever 32 which rests upon spring 34, or other biasing element as known in the art. A flexible air bag 36 that is vented to the ambient air outside the pressure regulator 26 is above the pivot lever 32 and in opposition to the spring 34. The compliant stopper 31, the pivoting lever 32, the spring 34, and air bag 36 are all within an enclosed ink passage 40. The bag 36 is in contact with the pivoting lever 32 and spring 34 applies pressure to the bag 36 to cause a negative pressure within the ink passage 40 of the pressure regulator 26.

In the process of printing, the print head ejects ink and causes ink to be drawn from the pressure regulator 26 through the ink passage 40. As the ink flows, the pressure inside the pressure regulator 26 is reduced and the bag 36 inflates slightly by drawing in ambient air to thus deflect the pivot lever and push it against the spring 34. This action causes the compliant stopper 31 to move away from the ink tube 30 thereby allowing more ink to flow from the carrier reservoir 14 and into the ink passage 40 and ultimately to the print head 38.

This embodiment of the pressure regulator is merely illustrative of one method of controlling ink flow from the carrier reservoir 14 to the print head 38, and other methods of controlling ink flow as are known in the art can alternately be used in the present invention. The ink pump 12 can pump ink either from the ink supply reservoir 16 to the print head 38, or can pump the ink from the ink supply reservoir 16 to the carrier reservoir 14 and then to the print head 38.

The important feature of the present invention is the pumping action created from deformation of the flexible wall 22. The pressure fluctuations in the carrier reservoir 14 will aid in moving ink through the ink supply tube 18 and to the print head 38. The print head 38 (which uses ink to print on a media) is mounted on a carrier that is moved across the width of the paper or other media in a straight line. As the print head carrier accelerates intermittently back and forth, it is accelerated and decelerated by a motor acting through a transmission as is known in the art. Each time acceleration (or deceleration) takes place a force is exerted on every part of the carrier in proportion to its mass.

The flexible wall 22, which can also be a plurality of walls, preferably includes a mass, such as an integral weight, to increase the inertial resistance so as to produce pressure variations in the on-carrier ink reservoir whenever the carrier is accelerated or decelerated, as shown by weight 24 on flexible wall 22. As such, the pressure on the fluid in the reservoir due to the acceleration of the carrier can be determined by:

$$P=P'+ma/A$$

where P is the pressure in the on-carrier reservoir, P' is the atmospheric pressure, m is the mass of the flexible wall 22, a is the acceleration of the carrier (perpendicular to the wall), and A is the area of the flexible wall 22.

Figure 2A:
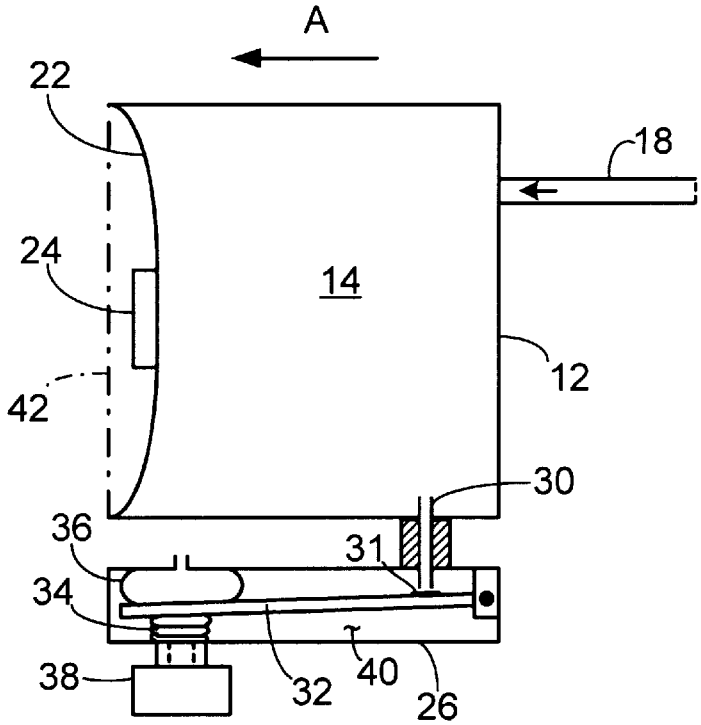
FIG. 2A is a view of the ink pump in FIG. 1 accelerating in the direction of Arrow A, with the flexible wall inwardly deforming into the carrier reservoir with ink flowing through the print head.
Figure 2B:
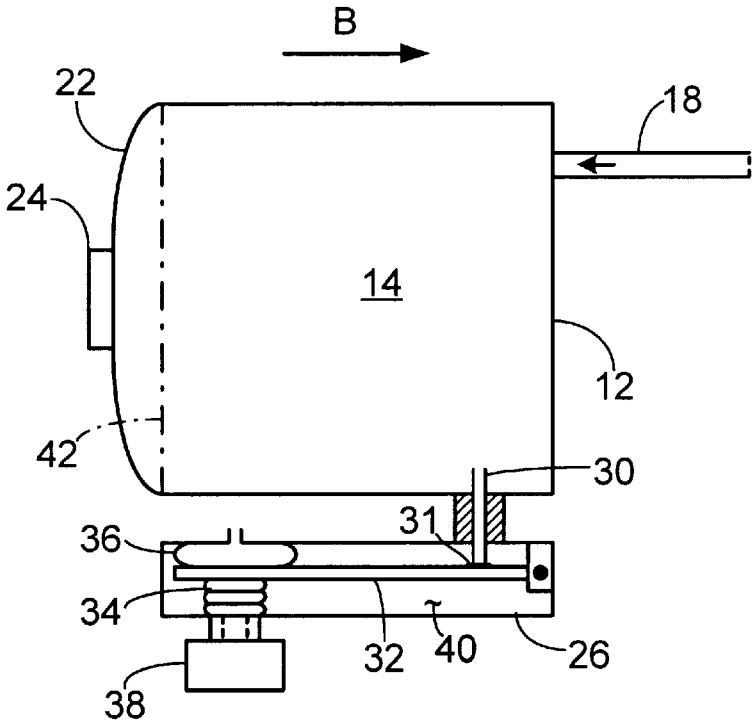
FIG. 2B is a view of the ink pump in FIG. 1 accelerating in the direction of Arrow B, with the flexible wall outwardly deforming and intaking ink into the carrier reservoir.

With reference to FIGS. 2A and 2B, the ink pump 12 is shown accelerating and decelerating and the flexible wall 22 is deforming in resistance to the acceleration of the moving carrier. In FIG. 2A, the ink pump 12 is accelerating in the direction of Arrow A and the flexible wall 22 is deforming into the carrier reservoir 14, and away from its original resting position 42. Such action creates positive pressure in the carrier reservoir 14, and if ink is required in the print head 38 as determined by the operation of the pressure regulator 26, can force ink into the pressure regulator 26. The pressure regulator 26 is thus shown as open with the compliant stopper 31 away from the ink tube 30 allowing ink to flow to the print head 38.

Conversely, when the ink pump 12 is accelerating in the opposite direction, or the direction of Arrow B in FIG. 2B, the flexible wall 22 deforms outwardly from its original resting position 42 and creates negative pressure in the carrier reservoir 14. The negative pressure causes the intake of ink from the ink supply tube 18 to fill the carrier reservoir 14.

FIGS. 2A and 2B also illustrate how a mass, such as integrated weight 24, on the flexible wall 22 increases inertial resistance to the acceleration of the ink pump 22, and thus, deformation of the flexible wall 22 during acceleration and deceleration.

Figure 3A:
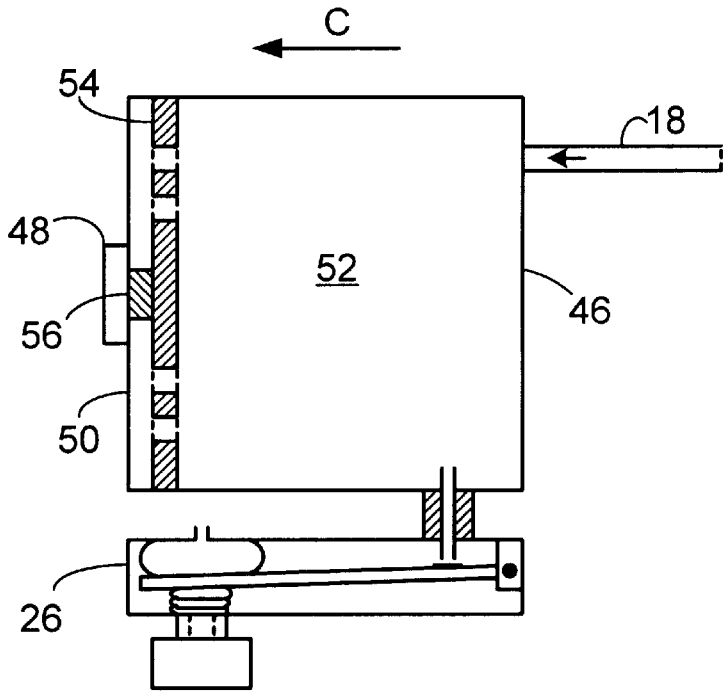
FIG. 3A is an alternate embodiment of the ink pump accelerating in the direction of Arrow C, with a rigid member preventing deformation of the flexible member into the carrier reservoir.
Figure 3B:
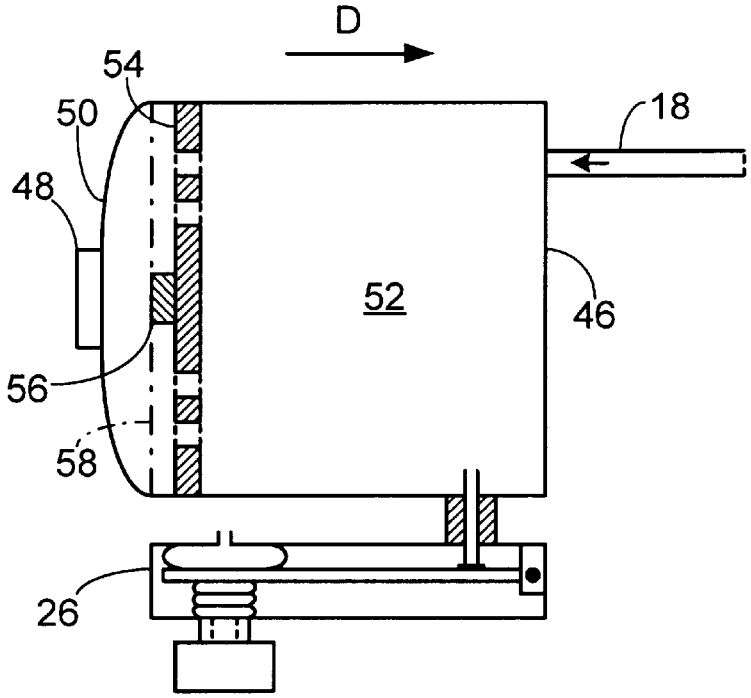
FIG. 3B is the embodiment of the ink pump shown in FIG. 3A accelerating in the direction of Arrow D, with the flexible wall outwardly deforming and intaking ink into the carrier reservoir.

FIGS. 3A and 3B illustrate an alternate embodiment of the ink pump 46 having an integrated weight 48 on the flexible wall 50 and a rigid member, shown here as porous wall 54 with upstanding member 56, which prevents deformation of the flexible wall 50 into the carrier reservoir 52. The inclusion of the rigid member maximizes the pumping action of the deforming flexible wall 50 because when the moving carrier and ink pump 46 accelerates in the direction of Arrow C, the upstanding member 56 on the porous wall 54 prevents the flexible wall 50 from significantly deforming into the carrier reservoir 52.

In FIG. 3B, when the ink pump 46 accelerates in the opposite direction to that of FIG. 3A, shown as the direction of Arrow D, the flexible wall 50 still deforms outwardly from the resting position 58 and causes a negative pressure to form within the carrier reservoir 52 to draw ink into the carrier reservoir 52. The pores in the porous wall 54 allow the ink to flow into the space between the porous wall 54 and the deforming flexible wall 50 and thus maximizes the negative pressure aspect of the ink pump 46 to draw ink into the carrier reservoir 52. The rigid member can be embodied alternately as any stop that is fixed to the structure of the reservoir in some other way and substantially prevents the flexible wall 50 from deforming into the carrier reservoir 52.

With reference again to FIGS. 1, 2A, and 2B, the inventive ink pump and system thus provide a method of supplying ink to a print head 38 on a moving carrier in a printer that includes the steps of providing ink in a stationary ink supply reservoir 16, accelerating the ink pump 12 with the moving carrier, and pumping ink from the ink supply reservoir 16 to a print head 38 using a flexible wall 22 in the ink pump 12 that deforms from inertial resistance to the acceleration of the moving carrier and ink pump 12. When the ink pump 12 further includes a carrier reservoir 14, the method further includes the step of pumping ink from the ink supply reservoir 16 to a carrier reservoir 14 using a flexible wall 22 in the carrier reservoir 14 that deforms from inertial resistance to the acceleration of the moving carrier.

Then the step of pumping ink from the ink supply reservoir 16 to a print head 38 using a flexible wall in the carrier reservoir 14 is preferably pumping ink from the carrier reservoir 14 to a print head 38 using a flexible wall 22 in the carrier reservoir 14 that deforms from inertial resistance to the acceleration of the moving carrier.

The method further preferably includes the step of integrating a mass, such as weight 24, with the flexible wall 22 such that the weight 24 increases inertial resistance of the flexible wall 22 to the acceleration of the moving carrier. Then, as shown in FIGS. 3A and 3B, the method preferably includes the step of restraining the deformation of the flexible wall 22 into an interior of the carrier reservoir 52, preferably through the provision of a rigid member, such as a porous wall 54, in the interior of the carrier reservoir 52 such that the rigid member prevents deformation of the flexible wall 50 into the interior of the carrier reservoir 52.

While there has been shown a preferred and alternate embodiments of the present invention, it is to be understood that certain changes may be made in the forms and arrangements of the components and steps of the inventive method without departing from the spirit and scope of the invention as set forth in the claims appended herewith. In addition, the corresponding structures, materials, and equivalents of all means-plus-function elements in the claims are intended to include any structure, material, or component as known to one of skill in the art for performing the function in combination with the other claimed elements.

What is claimed is:

1. An ink supply system for a print head on a moving carrier, comprising:

an ink supply reservoir;

an ink pump on the moving carrier, the ink pump having a carrier reservoir including at least one flexible wall, a print head, and a pressure regulator in fluid communication with the carrier reservoir and the print head, the flexible wall deforming from inertial resistance to acceleration of the moving carrier; and an ink supply tube in fluid communication with the ink supply reservoir and the carrier reservoir, wherein acceleration of the ink pump deforms the flexible wall and thereby pumps ink from the ink supply reservoir to the print head.

2. The system of claim 1, wherein the acceleration of the ink pump pumps ink from the ink supply reservoir to the carrier reservoir.

3. The system of claim 2, wherein the acceleration of the ink pump further pumps ink from the carrier reservoir to the print head.

4. The system of claim 1, wherein the flexible wall further includes a mass integrated therewith, the mass increasing inertial resistance to the acceleration of the moving carrier.

5. The system of claim 1, further including a check valve in the ink supply tube between the ink supply reservoir and the carrier reservoir.

6. The system of claim 1, wherein the carrier reservoir has an interior and further includes a rigid member in the interior of the carrier reservoir, the rigid member preventing deformation of the flexible wall into the interior of the carrier reservoir.

7. The system of claim 6, wherein the rigid member is a porous wall.

8. An ink pump on a moving carrier and connected to a print head, the ink pump comprising:

a rigid body having a interior comprising a carrier reservoir, the body including at least one flexible wall, and the flexible wall deforming from inertial resistance to acceleration of the moving carrier;

a pressure regulating means in fluid communication between the carrier reservoir and the print head, the pressure regulating means for regulating the pressure of ink flowing from the carrier reservoir and to the print head; and an ink supply means for supplying ink to the carrier reservoir.

9. The ink pump of claim 8, wherein the flexible wall further includes a mass integrated therewith, the mass increasing inertial resistance to the acceleration of the moving carrier.

10. The ink pump of claim 8, wherein the ink supply means is an ink supply tube in fluid communication with the carrier reservoir.

11. The ink pump of claim 8, wherein the carrier reservoir has an interior and further includes a restraining means in the interior of the carrier reservoir, the restraining means for preventing deformation of the flexible wall into the interior of the carrier reservoir.

12. The ink pump of claim 11, wherein the restraining means is a porous wall.

13. A method of supplying ink to a print head on a moving carrier in a printer, comprising the steps of:

providing ink in a stationary ink supply reservoir;

accelerating the moving carrier; and pumping ink from an ink supply reservoir to a print head using a flexible wall in the ink pump that deforms from inertial resistance to the acceleration of the moving carrier.

14. The method of claim 13, wherein:

the ink pump further includes a carrier reservoir, and the method further includes the step of pumping ink from the ink supply reservoir to a carrier reservoir using a flexible wall in the carrier reservoir that deforms from inertial resistance to the acceleration of the moving carrier; and the step of pumping ink from the ink supply reservoir to a print head using a flexible wall in the carrier reservoir that deforms from inertial resistance to the acceleration of the moving carrier is pumping ink from the carrier reservoir to a print head using a flexible wall in the carrier reservoir that deforms from inertial resistance to the acceleration of the moving carrier.

15. The method of claim 13, further including the step of integrating a mass with the flexible wall such that the mass increases inertial resistance of the flexible wall to the acceleration of the moving carrier.

16. The method of claim 13, further including the step of regulating the pressure of the ink supplied by the ink pump to the print head.

17. The method of claim 13, further including the step of restraining the deformation of the flexible wall into the interior of the carrier reservoir.

18. The method of claim 17, wherein the step of restraining the deformation of the flexible wall into an interior of the carrier reservoir is restraining the deformation of the flexible wall into an interior of the carrier reservoir through provision of a rigid member in the interior of the carrier reservoir such that the rigid member prevents deformation of the flexible wall into the interior of the carrier reservoir.

19. The method of claim 18, wherein the step of restraining the deformation of the flexible wall into an interior of the carrier reservoir through the provision of a rigid member in the interior of the carrier reservoir such that the rigid member preventing deformation of the flexible wall into the interior of the carrier reservoir is restraining the deformation of the flexible wall into an interior of the carrier reservoir through the provision of a porous wall in the interior of the carrier reservoir such that the porous wall prevents deformation of the flexible wall into the interior of the carrier reservoir.

* * * * *